US008674591B2

(12) United States Patent
Kessels et al.

(10) Patent No.: US 8,674,591 B2
(45) Date of Patent: Mar. 18, 2014

(54) GAS DISCHARGE LAMP WITH OUTER CAVITY

(75) Inventors: Marcus Jozef Henricus Kessels, Eindhoven (NL); Klaus Schoeller, Nideggen (DE)

(73) Assignee: Koninklijke Philips N.V., Eindhoven (NL)

( * ) Notice: Subject to any disclaimer, the term of this patent is extended or adjusted under 35 U.S.C. 154(b) by 605 days.

(21) Appl. No.: 12/307,770

(22) PCT Filed: Jun. 28, 2007

(86) PCT No.: PCT/IB2007/052514

§ 371 (c)(1),
(2), (4) Date: May 11, 2009

(87) PCT Pub. No.: WO2008/007284

PCT Pub. Date: Jan. 17, 2008

(65) Prior Publication Data

US 2010/0045197 A1 Feb. 25, 2010

(30) Foreign Application Priority Data

Jul. 7, 2006 (EP) ..... 06116769

(51) Int. Cl.
*H01J 1/02* (2006.01)

(52) U.S. Cl.
USPC ..... 313/26

(58) Field of Classification Search
USPC ..... 313/26
See application file for complete search history.

(56) References Cited

U.S. PATENT DOCUMENTS

| | | | | |
|---|---|---|---|---|
| 5,942,840 | A | 8/1999 | Steere et al. | |
| 5,990,599 | A | 11/1999 | Jackson et al. | |
| 6,528,946 | B2 * | 3/2003 | Ishigami et al. | 313/637 |
| 6,624,580 | B2 | 9/2003 | Kanegae et al. | |
| 2004/0256991 | A1 * | 12/2004 | Minamihata et al. | 313/626 |
| 2005/0017643 | A1 | 1/2005 | Hendrix et al. | |
| 2005/0140295 | A1 * | 6/2005 | Van Den Nieuwenhuizen | 313/567 |
| 2005/0206326 | A1 | 9/2005 | Suzuki et al. | |

FOREIGN PATENT DOCUMENTS

| | | | |
|---|---|---|---|
| EP | 0938127 | A1 | 8/1999 |
| EP | 1069596 | A2 | 1/2001 |
| EP | 1107285 | A2 | 6/2001 |
| EP | 1398824 | A2 | 3/2004 |
| WO | 2004057644 | A1 | 7/2004 |
| WO | 2004083900 | A2 | 9/2004 |

* cited by examiner

*Primary Examiner* — Anh Mai
*Assistant Examiner* — Hana Featherly

(57) ABSTRACT

A gas-discharge lamp (1) is described having two electrodes (4, 5) that project into the discharge vessel (3) of the lamp. The lamp further comprises an outer envelope (18) that surrounds the discharge vessel (3), with an airtight seal, while leaving an outer cavity (20) between itself and the discharge vessel (3) and that is filled with a gas at a pressure of not more than 1,000 mbar. In the outer cavity (20), there is a single conductor, electrically connected to one of the electrodes, that is in direct contact with the gas filling in the cavity (20) to allow a high-voltage pulse to be applied for igniting a discharge between the conductor and its surroundings. Also described are a method of operating a gas-discharge lamp of this kind and various methods of producing gas-discharge lamps of this kind.

18 Claims, 5 Drawing Sheets

GAS DISCHARGE LAMP WITH OUTER CAVITY

The invention relates to a gas-discharge lamp having an inner envelope comprising a discharge vessel and two tubular sections arranged on the discharge vessel, from which tubular sections there project, into the discharge vessel, electrodes that, to enable them to be supplied with power, are electrically connected to respective electrical conductors that extend through the associated tubular sections and that are enclosed in the tubular sections with a gastight seal along a sealing section. This gas-discharge lamp also has an outer envelope that is connected at each of its ends to respective ones of the tubular sections of the inner envelope and that surrounds the discharge vessel, with an airtight seal, while leaving an outer cavity between itself and the discharge vessel. The invention also relates to a method of operating a gas-discharge lamp of this kind and to various methods of producing gas-discharge lamps of this kind.

Gas-discharge lamps constructed in the manner specified in the opening paragraph are often what are termed high-pressure gas-discharge lamps, such for example as high-pressure sodium lamps or particularly MPXL (Micro Power Xenon Light) lamps, or in particular corresponding mercury-free high-pressure gas-discharge lamps. In all these lamps, the discharge vessel (normally also referred to as the "burner") contains only a few micro-liters of gas. The effectiveness of such lamps with regard to the production of light is all the higher the higher is the pressure of the inert gas present in the discharge vessel. Unfortunately, a higher pressure for the inert gas means that it becomes more difficult to ignite a discharge in the gas.

To start lamps of this kind, a discharge has to be produced between the electrodes inside the burner. As a rule, this is achieved by means of a pulse of very high voltage between the two electrodes. Given a sufficiently high electrical field, electrons are emitted into the space for the discharge and, after an avalanche-like multiplying process, a conductive path made up of free electrons and ionized atoms and/or molecules forms between the electrodes, along which the gas-discharge can then take place. What is essential for the process described above is the availability of free electrons, particularly at the beginning of the breakdown. A vast variety of procedures can be adopted to produce these free electrons.

One possibility is to apply a very high electrical field to the electrodes in a time that is as short as possible, i.e. a very high and steep starting pulse. Alternatively, a voltage of a sufficiently high level can also be applied over a time which is, as appropriate, longer. However, there are many applications, particularly to motor-vehicle headlamps for example, where the lamps have to start reliably within a very short time of being switched on. What this means is that, to ensure reliable starting both in the cold state and in the hot state, e.g. when a fresh start is to take place shortly after the lamp has been switched off, powerful starting pulses of a sufficiently high level have to be made available at all times. This calls for igniter circuits that are relatively powerful and complicated and thus expensive and large in size. Also, a higher igniting voltage accentuates the problem of the electromagnetic interference caused by the lamp in other electronic components in its surroundings, e.g. in the vehicle's electronic system. More energetic steps therefore also have to be taken to screen off or prevent the electromagnetic interference pulses caused by the starting processes.

Another possible way of making ignition easier is to introduce radioactive substances, such for example as Kr-85 or Th, into the lamp. However, because of the greater hazard thereby created in the production of the lamps and for environmental reasons, radioactive substances of this kind should be avoided in lamps.

It is also known for the igniting voltage to be reduced in high-pressure discharge lamps with the help of what is termed an "auxiliary start antenna". In this way, there are described in, for example, EP 1 069 596 A2 antennas that are run along the discharge vessel or are looped around it and to which a positive potential is applied. What this gives is a sort of auxiliary electrode that is intended to cause an increase in the electrical field in the interior of the discharge vessel. "Active" antennas of this kind, which are raised to a given potential for ignition, are generally relatively complicated in design and are therefore often too expensive for mass production. One of the reasons for this is that it is extraordinarily difficult for a stable antenna to be housed in the vicinity of the hot burner.

Another known variant manner of assisting the starting of such lamps is the provision of UV photons in the starting process by means of what are termed "UV-enhancers", as described in U.S. Pat. No. 5,942,840 for example, or by means of what is called a dielectric barrier discharge (DBD) in the outer envelope, as described in U.S. Pat. No. 6,624,580 B2 for example. However, the ignition of such UV-enhancers or of a dielectric barrier discharge in the outer envelope once again requires the presence of free electrons. When an ignition aid of this kind is used, the problem thus exists of igniting, as quickly and as easily as possible, a discharge in the UV-enhancer or the outer envelope that will supply the desired UV photons for the discharge and will then extinguish again at a similar high speed. Thus, the problem is, to some degree, simply shifted from the burner to the ignition aid.

It is therefore an object of the present invention to provide an alternative to the gas-discharge lamps known in the prior art and one that can be produced with little cost and effort and that starts reliably even at reduced igniting voltages, and to specify a method of operating a gas-discharge lamp of this kind and a suitable method of producing a gas-discharge lamp of this kind.

This object is achieved, on the one hand, by a gas-discharge lamp as claimed in Claim 1 and, on the other hand, by a method of operating a gas-discharge lamp of this kind as claimed in Claim 10 and by the methods of producing a gas-discharge lamp claimed in Claims 12, 13, 14 and 15.

In the gas-discharge lamp according to the invention, it is ensured that the outer cavity between the discharge vessel and the outer envelope, which outer cavity is sealed off to be airtight, is filled with gas at a pressure of not more than 1000 mbar. It is also ensured that only a single conductor is in direct contact with the gas filling in the said outer cavity. To allow a high-voltage pulse for igniting a discharge in the cavity, or in other words in the outer envelope, to be applied between the conductor and its surroundings, the said conductor is run out of the outer envelope. It has been found that, if the outer envelope is filled at a pressure of less than 1000 mbar and a suitable high-voltage pulse is applied only to a single uninsulated conductor in the outer envelope, a discharge that ignites relatively quickly will form around this conductor between it and its surroundings when a high-voltage pulse is applied. Initially, this is presumed to be a corona discharge, which then changes into a dielectric barrier discharge between the conductor and for example one of the electrodes or its supply conductor, which latter runs through the outer envelope and into the discharge vessel with insulation in the section of quartz glass and is at an appropriate different potential such for example as ground potential.

In a corresponding method of operating a gas-discharge lamp of this kind, a corresponding high-voltage pulse therefore simply has to be applied to the conductor in contact with the gas filling in the outer cavity, simultaneously with or immediately prior to the application of a starting pulse to the electrodes of the high-pressure gas-discharge lamp.

As soon as the ignition of the discharge between this conductor in the outer envelope and its surroundings has taken place, the desired UV photons are formed that facilitate the ignition of the gas-discharge proper in the discharge vessel. Because it is only this conductor that is in contact with the gas filling and there is no other uninsulated conductor at a different potential present in the outer envelope, there cannot be a direct discharge between two conductors in the outer envelope. At most, the desired dielectric barrier discharge can take place to one of the electrodes in the discharge vessel, a discharge which however can only be maintained by suitable high-frequency pulses or in other words by a suitable high-frequency voltage. This being the case, the statement that there is to be only a single conductor in direct contact with the gas filling in the outer cavity between the outer envelope and the discharge vessel, is to be understood to mean that no second conductor separate from this first conductor, which second conductor might be at an uninsulated opposing potential to ignite a direct discharge between the conductors, is provided in the cavity in the outer envelope.

The dependent claims and the remainder of the description each cover particularly advantageous embodiments and refinements of the invention.

In a particularly preferred variant of the method of operating the lamp, the starting pulse, which is also applied to one of the electrodes to ignite the discharge in the discharge vessel, is simply applied simultaneously to the conductor in contact with the gas filling in the outer cavity. What this means is that the high-voltage pulse for the conductor in contact with the gas filling in the outer cavity is identical with the starting pulse for the electrode for igniting the lamp. For this purpose, the conductor in contact with the gas filling in the outer cavity has to be electrically connected to the electrical conductor concerned that runs to the electrode. In a variant of particularly simple design, the electrical conductor running to the electrode concerned itself forms the conductor in contact with the gas filling in the outer cavity.

For this purpose, it is enough for the electrical conductor to be freed at one point from the insulation by the glass. In a particularly simple and therefore preferred variant, there is simply a hole in the tubular section, which hole extends from the outer cavity between the inner envelope and the outer envelope into the tubular section and to the electrical conductor. The hole in question is preferably a relatively small circular hole. It may however also be a hole or piercing of any other desired shape.

A lamp of this kind is particularly easy to produce.

In a method according to the invention of producing a gas-discharge lamp of this kind the following method steps, amongst others, are progressed through:

An inner envelope having a discharge vessel and two tubular sections arranged on the discharge vessel is first produced.

The introduction then takes place of two electrodes that project from the tubular sections into the discharge vessel, which electrodes, to enable them to be supplied with power, are electrically connected to respective electrical conductors that extend through the associated tubular sections, and the discharge vessel is filled with the desired filling materials, such for example as mixtures of inert gases, metal halides, mercury if required, etc. and the electrical conductors are enclosed in the respective tubular sections with a gastight seal along a respective sealing section. There is a range of possible methods of performing this process. In this way, one electrode may for example be introduced first and a first pinch, or the like, may be made on the side concerned to seal in the electrical conductor concerned. The filling materials may then be fed in, the second electrode inserted and the inner envelope closed off with an airtight seal on the second side. Certain flushing and de-gassing steps are generally necessary in this case to decontaminate the inner envelope and the filling materials and electrodes that are to be introduced. However, the enormous variety of different methods of producing, filling and sealing-off lamp envelopes are familiar to the person skilled in the art and there is therefore no need for them to be explained in detail here.

In accordance with the invention, a hole is then made in the tubular section associated with one of the two electrical conductors running to the electrodes to expose the electrical conductor in this area.

The making of a hole in the tubular section may take place in various ways. In this way, the hole may be bored or, by a preferred method, may be made in the tubular section with a laser. By another, more inexpensive, method, the hole is simply impressed at the same time during a pinching process in which the sealing section is produced in the tubular section.

Finally, the outer envelope can then be attached to the tubular sections of the inner envelope in the usual way, by for example connecting the material of the outer envelope to the material of the tubular sections of glass with an airtight seal at what is termed a "roll-on". When this is done, suitable care must of course be taken to see that the point at which the outer envelope is attached to the given tubular section is outside the hole in the tubular section, i.e. that the hole is situated inside the outer envelope. When the outer envelope is being attached, the cavity between the outer envelope and the inner envelope is also filled with the desired gas at a pressure of not more than 1,000 mbar at the same time. Appropriate sealing and filling methods are sufficiently well known to the person skilled in the art and there is therefore no need for them to be explained in detail here.

When the hole is made in the tubular section, it must of course be ensured that a point does not arise at which there is not a seal. What this means is that it must be ensured that the hole does not produce a connection between the interior of the discharge vessel and the cavity between the outer envelope and the inner envelope and that the outer envelope is also sealed off from the surroundings.

A hole of this kind is therefore preferably made in the region of the sealing section or between two adjacent sealing sections, which may be spaced apart from one another if required, of the tubular section concerned.

As a particular preference, it is also ensured that the electrical conductor is formed, in the region of the hole, by a metal strip, such as a molybdenum foil for example. Within the sealing sections, the electrical supply conductors to the electrodes usually comprise a molybdenum foil anyway. What this means is that the electrodes are for example firstly connected to molybdenum foils that, at the outer end, are connected in turn to molybdenum wires or the like that then serve as connections outside the lamp. The seal in the tubular section is made in this case in such a way that the molybdenum foil is completely enclosed in the sealing section.

Because the discharge vessel becomes very hot in operation, it is preferable for the hole in the sealing section to be as far away as possible from the discharge vessel to prevent the point of contact with the supply conductor from becoming oxidized if there is oxygen present in the filling of the outer envelope. The hole in the sealing section should therefore preferably be spaced at least 12 mm and, as a particular preference, at least 15 mm, away from the tip projecting into the discharge vessel of the electrode that is connected to the electrical conductor concerned, i.e. from the discharge arc. To achieve this, a metal strip that is longer than usual and that is of a length of, for example, at least 10 mm and preferably at least 12 mm may simply be connected to the relevant end of the electrode, in the course of manufacture for example.

In an alternative preferred variant, the electrical conductor at this end of the electrode is formed, in two sections spaced apart from one another, by portions of metal strip. What this means is that the electrical conductor used is one that is composed, at the electrode end, of a first portion of metal strip that is connected directly to the electrode. At the end pointing away from the electrode, a metal wire is connected in the usual way to this portion of metal strip. However, this metal wire is relatively short and is connected in turn to a portion of metal strip that, at the outer end, is finally connected in turn to a metal wire that, in the end, acts as a contact outside the lamp. Two sealing sections that cover the two portions of metal strip are then made at this end of the electrode. Alternatively, one continuous sealing section may also be made, which is sufficiently long to cover both the portions of metal strip. The seal can be made in both cases by a pinching process or by a vacuum process. In the case of an electrical conductor of this design, the hole is then preferably made in the sealing section at the portion of metal strip further away from the discharge vessel or in the region of the wire between the portions of metal strip. Molybdenum is preferably once again used as the material for the portions of metal strip and the metal wires.

In another embodiment of a gas-discharge lamp according to the invention, the electrical conductor that is in contact with the gas filling in the outer cavity and runs to one of the electrodes is run into the outer envelope, at a first end-face thereof, at a distance from the second electrical conductor that runs to the other electrode. This electrical conductor is then run though the outer envelope uninsulated and, at the end of the inner envelope remote from the first end-face of the outer envelope, is run into the tubular section situated there and is connected to the associated electrode. This gives a particularly compact form of lamp because the return conductor does not have to be run back to the cap outside the outer envelope in the way that it usually does. In this case the electrical conductor that runs to the electrode farther away from the cap is thus the one that is in exposed contact with the gas filling in the outer envelope. In this embodiment, it is therefore to this conductor that the starting pulse for ignition should be applied.

One possible way of producing a gas-discharge lamp of the present kind is to produce, in the usual way, an inner envelope having a discharge vessel and two tubular sections arranged on the discharge vessel. Two electrodes can then, once again, be introduced into the discharge vessel from the tubular sections, which electrodes are electrically connected to respective electrical conductors that extend through the associated tubular sections, and the discharge vessel can be filled with the desired filling materials and the electrical conductors can be enclosed in their respective tubular sections with a gastight seal along a sealing section. However, it must then be ensured that one of the electrical conductors is run back from the associated tubular section along the inner envelope, on the outside, to that end of the inner envelope at which the other tubular section is arranged. Finally, the inner envelope has to be enclosed by an outer envelope with an airtight seal while leaving a cavity between the discharge vessel and the outer envelope. When this is done, it must be ensured that the electrical conductor that is run back along the inner envelope on the outside extends inside the outer envelope at an adequate distance from the inner envelope and is run out of the outer envelope with a seal at an end-face of the outer envelope situated at the opposite end from the associated tubular section. In this case too, the cavity should be filled with a gas at a pressure of not more than 1,000 mbar.

In a further alternative embodiment, the lamp is so designed that the conductor is run from outside into the outer cavity through the associated tubular section or along the associated tubular section substantially parallel to an electrical conductor running to the electrodes. In this variant, the conductor is thus a separate conductor that is not necessarily in contact with one of the two electrical conductors for the electrode. Accordingly, this conductor may therefore also have a different starting pulse applied to it than the conductor connected to the electrode. Hence, for example, the starting pulses for the additional conductor and for the supply conductor to the electrode may thus be positioned a short interval of time behind one other or voltage pulses of different amplitudes and/or different shapes may be selected. However, with this variant the method of producing the lamp is more complicated and hence more expensive.

A variant manner of producing a gas-discharge lamp of the kind concerned comprises, after the inner envelope has been produced, filled and sealed and when, for example, the outer envelope is being attached to the tubular sections of the inner envelope and the cavity is being filled to the desired pressure, at the same time bringing a conductor, which is run through into the outer envelope from outside, into the outer cavity between the discharge vessel and the outer envelope and into contact with the gas filling. For example, for this purpose a wire can be run parallel to the tubular section of the inner envelope and, when the outer envelope is fastened to the inner envelope, can be run through the roll-on.

In another variant, care is taken even when the inner envelope is being produced to see that an additional conductor, such for example as a second molybdenum wire, is introduced into one of the two tubular sections in such a way as to be insulated from the electrical conductor that runs through the tubular section concerned to the electrode. When the tubular section is being sealed off, it must then be ensured that the additional conductor is run out of the tubular section laterally, or a hole to the additional conductor has to be made in the tubular section, so that the conductor is exposed. The attaching of the outer envelope to the tubular sections of the inner envelope can then take place in the usual way, care once again being take to see that the cavity is filled with a gas at a pressure of not more than 1000 mbar. As a result of the appropriate preparation of the inner envelope with the additional conductor, no special process steps are then required in this part of the method.

What are preferably used as filling gases in the outer cavity between the inner envelope and the outer envelope are inert gases (Xe, Kr, Ar, Ne, He), oxygen and nitrogen or mixtures of these gases. The pressure is preferably between 10 and 300 mbar and, as a very particular preference, between 10 and 100 mbar. The best ignition results are obtained at these pressures. With regard to the quantity of light from and length of life of the given types of lamp, what is crucial in this case is the trade-off between the ignition pulse required and balanced temperature conditions in the lamp.

The invention is particularly well suited to the preferred high-pressure gas-discharge lamps mentioned at the beginning, because the improvement in ignition achieved with it is all the greater the higher are the breakdown voltages required. This being the case, the greatest effect is achieved in the very small high-pressure gas-discharge lamps mentioned at the beginning. As well as this, the invention can, however, also be advantageously applied to other gas-discharge lamps. What is more, the invention is particularly advantageous when used in lamps for the automobile industry. However, advantageous use is also possible in lamps for other purposes, such as lamps for projection systems.

These and other aspects of the invention are apparent from and will be elucidated with reference to the embodiments described hereinafter. The same components are identified in the drawings by the same reference numerals. It is explicitly pointed out that the drawings are only schematic and are not true to scale.

Figure 1:
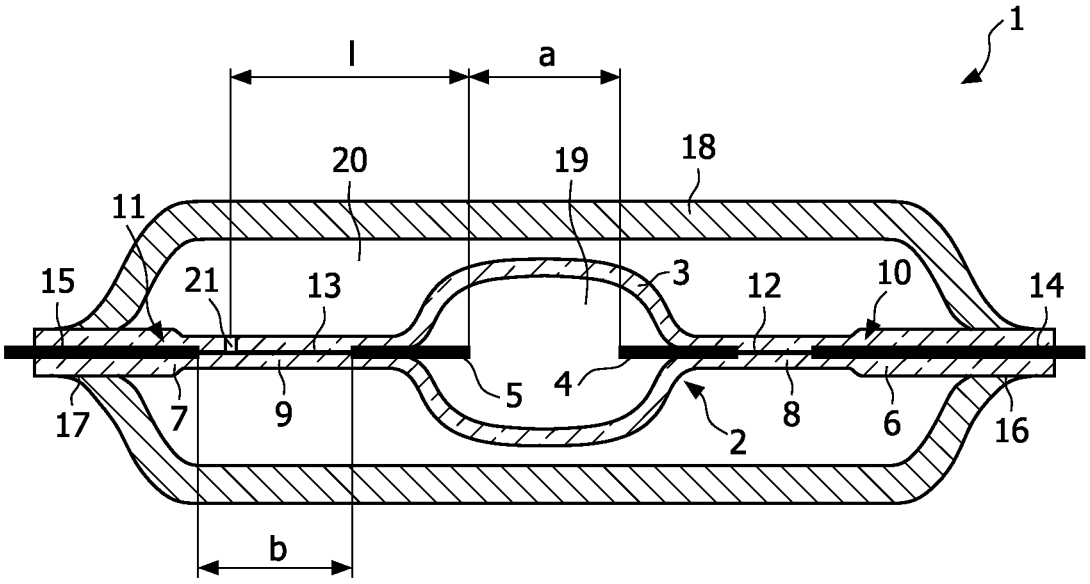
FIG. 1 is a section through a first embodiment of gas-discharge lamp according to the invention.
Figure 2:
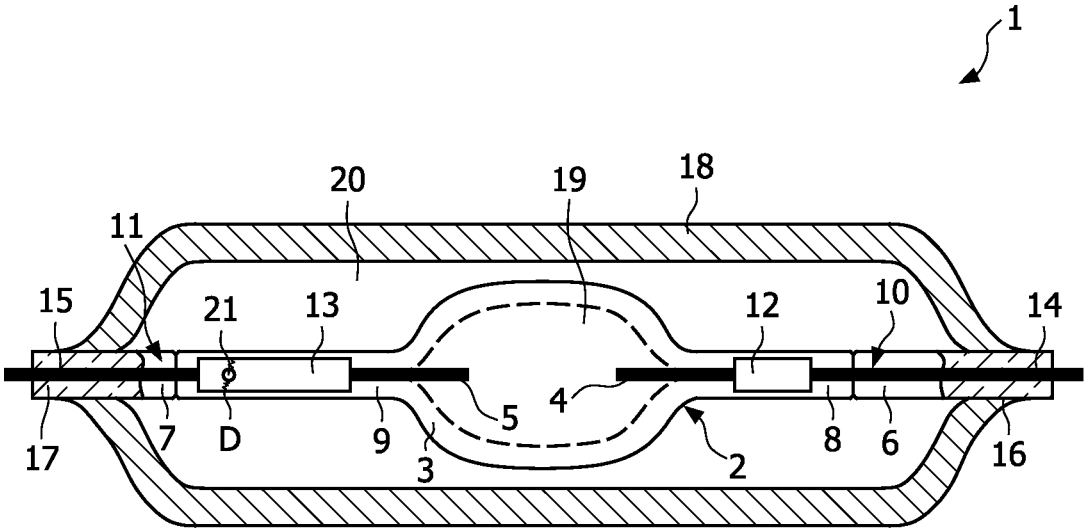
FIG. 2 is a plan view, in section through the outer envelope, of the gas-discharge lamp shown in FIG. 1.

The embodiment shown in FIGS. 1 and 2 is, without the invention being limited thereto, an MPXL lamp that is constructed in the usual way to have an inner envelope 2 and an outer envelope 18 surrounding the said inner envelope 2.

The inner envelope 2 comprises in this case the actual discharge vessel (burner) 3 of quartz glass that has tubular sections 6, 7 integrally formed on the discharge vessel 3 at respective ones of two opposing ends thereof. These tubular sections 6, 7 will also be referred to in what follows as "quartz glass end-pieces". Respective electrodes 4, 5 project from these quartz glass end-pieces 6, 7 into the discharge vessel 3.

The optical distance a between the tips of the electrodes is 4.2 mm. In the sealing sections 8, 9, the electrodes 4, 5 are connected to respective electrical conductors 10, 11 that project out of the quartz glass end-pieces 6, 7 at the ends thereof and act, on the outside, as contacts. These electrical conductors 10, 11 firstly comprise a relatively thin metal strip 12, 13, such for example as a molybdenum foil, which is connected to the electrode 4, 5 at one end and, at the other end, is connected in turn to a supply wire 14, 15 that finally projects from the quartz glass end-piece 6, 7, on the outside. The supply wire 14, 15 may for example be a molybdenum wire. In the region of the metal strips 8, 9, the quartz glass end-pieces 6, 7 take the form of sealing sections 8, 9 that enclose the metal strip 12, 13 concerned with a seal. This seal may for example be made in the usual way by pinching the relevant quartz glass end-piece 6, 7. The sealing sections 8, 9 are therefore also usually referred to as "pinches". It is ensured in this way that the discharge vessel 3 is sealed off from the surroundings with an airtight, or rather gastight, seal.

In the interior 19 of the discharge vessel 3 is the inert gas at a relatively high pressure. Because of this inert gas, a discharge arc forms between the two electrodes 4, 5 when the lamp 1 ignites and can then be maintained, in steady-state operation, by a voltage that is very low in relation to the igniting voltage. In conventional lamps, the igniting voltage is usually of the order of 16 to 25 kV and the operating voltage for the steady-state range is 40 to 100 volts. In the embodiment shown in the drawings, the ignition voltage is in each case applied to the electrical conductor 11 shown on the left of the drawings.

The inert gas may in principle be any desired inert gas that is normally used. Similarly, the lamp may also contain mercury. However, the greatest improvement in willingness to ignite is achieved particularly in mercury-free lamps because it is in these lamps that ignition is generally an even greater problem than in mercury-containing lamps. From another aspect, mercury-free lamps are to be preferred for environmental reasons. It is therefore particularly preferred for the invention also to be used in mercury-free lamps.

The chief purpose of the outer envelope 18 is to screen off the UV radiation that, due to the physical processes in the discharge vessel, occurs in addition to the desired spectrum of light. The said outer envelope 18 is usually likewise manufactured from quartz glass, suitably doped, and is connected at the ends to the quartz glass end-pieces 6, 7 of the inner envelope 2 at what are termed the roll-ons 16, 17. These roll-ons 16, 17 are likewise made in such a way as to be gastight and the gap 20, i.e. the outer cavity 20, between the inner envelope 2 and the outer envelope 18 is filled with a gas or a mixture of gases, even with air if required, at a preferred pressure of 10 to 300 mbar and, as a particular preference, of less than 100 mbar.

The lamp 1 is generally held in a cap (not shown) at that end that has the supply conductor 11 for the igniting voltage. The gas-discharge lamp 1 is generally connected solidly to the cap by means of a suitable mounting in this case and forms with it a common lamp unit. The conductor 10 connected to the electrode 4 situated further away from the cap is generally connected to an external electrical return conductor (not shown) that runs back to the cap past the outer envelope 18. A light unit of this kind can be used in a vast variety of lights that have a suitable receptacle to hold the cap and in particular in motor vehicle headlamps.

To improve the willingness of the lamp 1 to ignite, a hole 21, which runs from the cavity 20 in the outer envelope 18 through the quartz glass of the sealing section 9 and to or through the metal strip 13, is made in the sealing section 9.

The making of the hole 21 in the region of the sealing section 9 over the metal strip 13 has the advantage that, despite the hole 21, the sealing section 9 is still sealed in both directions, i.e. both in relation to the interior 19 of the discharge vessel 3 and in relation to the outside environment.

Because the discharge vessel 3 becomes very hot in operation, the hole 21 is preferably made in the sealing section 9 at a relatively long distance from the discharge vessel 3, to prevent oxidation of the metal strip that is possible if there are oxidizing gases present in the outer envelope. For this purpose, the sealing section 9 concerned on the side on which the electrical conductor 11 carrying the voltage pulse is situated is formed to be somewhat longer than on the other side, or in other words a longer metal strip 13, as appropriate, is used at this point. The length b of the metal strip 13 is approximately 15 mm in the present case. Otherwise, molybdenum strips of a length of only approximately 7 mm are generally used in such lamps, as shown on the side on which the other electrode 4 is situated. Because of this longer metal strip 13, it is possible for the hole 21 to be arranged over the metal strip 13 at a distance 1 of, for example, approx. 15 mm from the tip of the electrode 5 concerned, i.e. from what will later be the discharge arc.

This hole puts the supply conductor 11 to the electrode 5 in contact with the gas in the interior 20 of the outer envelope 18. The design of the lamp as a whole ensures in this case that the conductor 11 is the only current-carrying conductor that is in direct contact with the filling gas in the outer envelope 18 and that there is no other uninsulated conductor at a different potential within the outer envelope 18. If an ignition pulse is now applied in the usual way to the supply conductor 11 to the electrode 5, a discharge D comes into being between the conductor 11 and its surroundings as a result of the suitably set pressure in the interior 20 of the outer envelope 18.

The UV photons produced in the course of this discharge are enough to speed up the ignition inside the discharge vessel. As soon as the pulse of high voltage ceases, the discharge automatically extinguishes.

The entire physical process is presumed to take place in such a way that a corona discharge D, which is shown schematically in FIG. 2, firstly occurs, around the hole, between the exposed electrical conductor 11 and the surroundings. This corona discharge D then initiates, for a brief period, a dielectric barrier discharge within the outer envelope 18, which discharge is at once extinguished again on the discharge arc igniting in the discharge vessel 3. The mechanism by which the process operates was examined with the help of a very high-speed ICCD camera whose gate speed was <20 nsec and which enabled the light within the lamp 1 to be sensed immediately prior to the breakdown in the burner 3.

Figure 3:
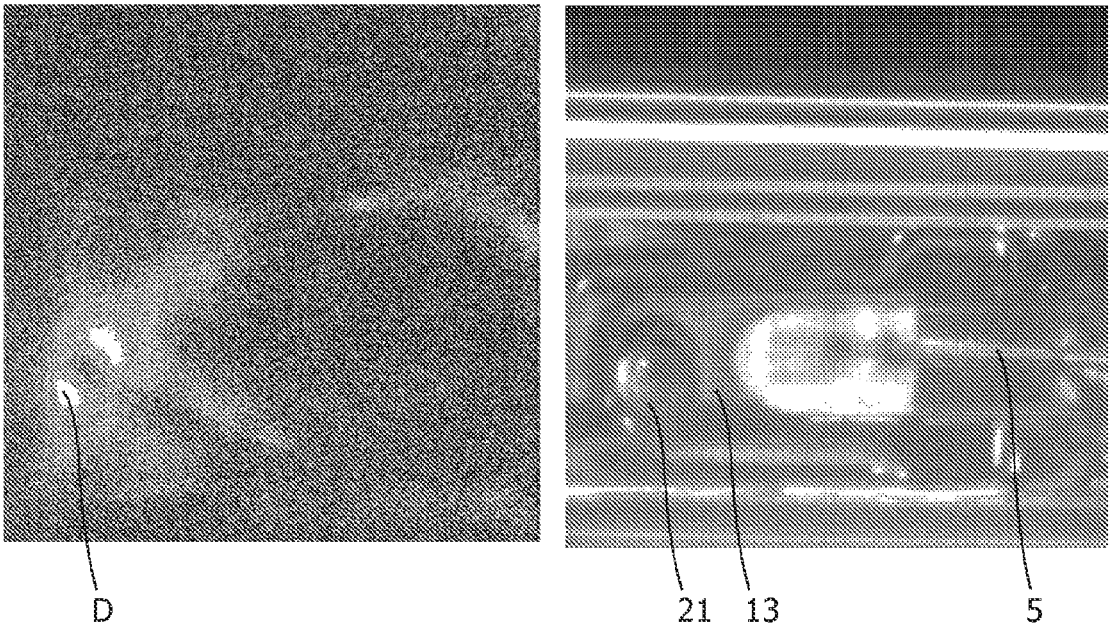
FIG. 3 is a photograph of the discharge at the supply conductor that is in contact with the gas in the cavity between the outer envelope and the inner envelope, of a lamp (shown in the right-hand image) of similar construction to that shown in FIG. 2 and, for comparison, a photo of the corresponding part of the lamp without the discharge.

Shown in FIG. 3 on the left-hand side is a photograph taken with a camera of this kind, during the ignition process, of an XenEco D4 vehicle lamp that had been prepared in accordance with the invention, i.e. that had been provided with a hole in the sealing section of the quartz glass holding the supply conductor carrying the ignition pulse. The lamp in question was a mercury-free lamp of the D4R type having a rated power of 35 watts. The optical distance between the electrodes was approx. 4.2 mm. The outside diameter of the outer envelope was 8.7 mm and its wall thickness 1 mm, and the outside diameter of the inner envelope was 6.1 mm and its wall thickness approx. 1.7 mm. The volume of the discharge vessel was approx. 20 μl in this case. The filling comprised various metal salts. The pressure in the inner envelope of the lamp was approx. 10 bar. The filling in the interior of the outer envelope comprised a mixture of nitrogen and oxygen. The pressure in the interior of the outer envelope was approx. 100 mbar.

The discharge between the supply conductor and its surroundings can clearly be seen in the photo as a corona discharge D around the hole. However, it can also be seen that, as well as at the corona discharge D, light occurs at other points within the outer envelope, i.e. that photons also occur there. This indicates that a dielectric barrier discharge is finally triggered within the outer envelope as a whole immediately after the ignition of the discharge around the hole 21.

The photo on the right was taken as a comparison when there was no discharge. In it can be seen the molybdenum foil and the electrode wire mounted at the right-hand end of the molybdenum foil. Also clearly visible is the hole 21 made in the section of quartz glass by which part of the molybdenum foil is exposed.

Figure 4:
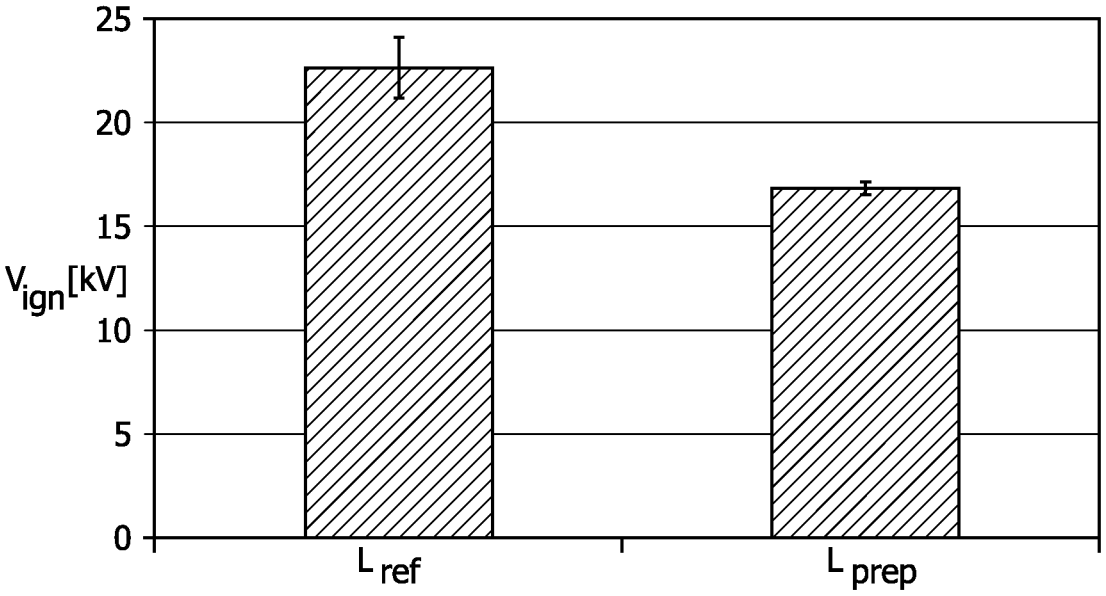
FIG. 4 is a bar chart to illustrate the willingness to ignite of a lamp constructed in accordance with the invention as compared with a conventional reference lamp.

FIG. 4 shows the results of initial test measurements on a lamp prepared in this way (the bar on the right marked $L_{prep}$), as compared with a conventional lamp of the same type not prepared in accordance with the invention that was used as a reference (the bar on the left marked $L_{ref}$). The Figure shows that it is not only the mean ignition voltage $V_{ign}$ that can be reduced by means of the invention but also the width of the scatter to which it is subject, which is indicated by the respective error lines in FIG. 4.

Figure 5:
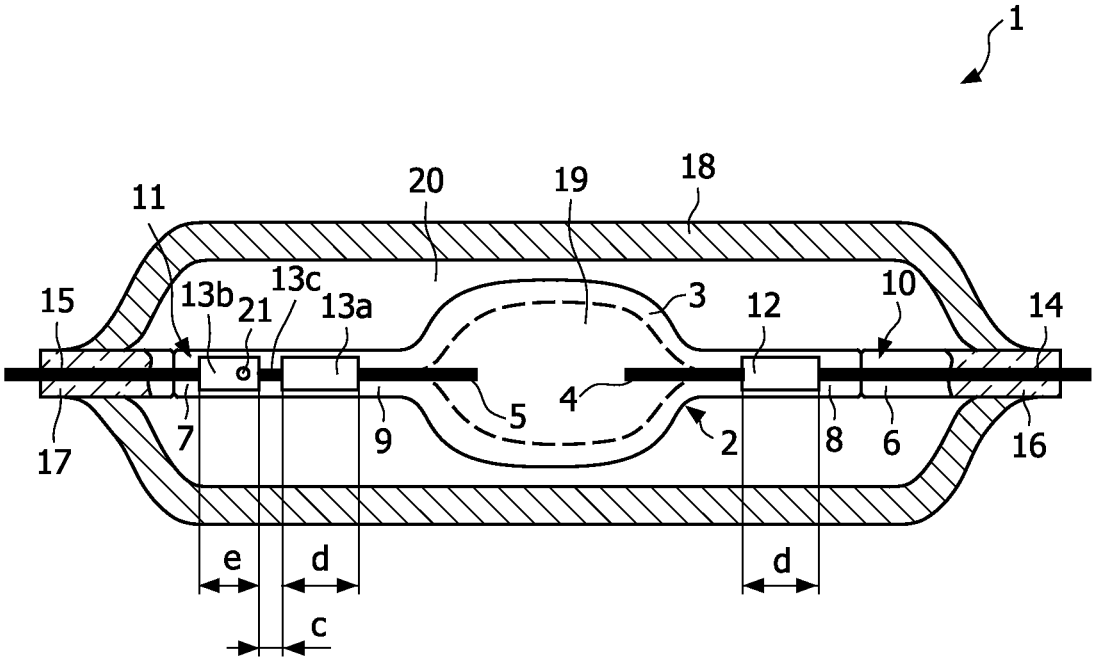
FIG. 5 is a plan view, in section through the outer envelope, of a second embodiment of a gas-discharge lamp according to the invention.

FIG. 5 shows a slightly modified variant of the lamp 1. In principle, the lamp 1 is constructed in an absolutely identical way to the lamp shown in FIGS. 1 and 2. The only way in which the design differs slightly is in the actual form taken by the electrical conductor 11 in the region of the sealing section 9 situated on the same side as the electrode 5 to which the igniting pulse is applied.

What are used at this point in place of a lengthened metal strip 13 (as in FIGS. 1 and 2) are two portions of metal strip 13*a*, 13*b* that are connected together by means of a metal wire 13*c*, preferably a molybdenum wire. The hole 21 is then made over the portion 13*b* of metal strip that is situated further out.

The sealing section 9 can be produced in two stages in this case, i.e. a pinch is for example first made around the portion 13*a* of metal strip near to the electrode and a second pinch is then made around the portion 13*b* of metal strip situated further out. In this case too, the distance between the hole 21 and the tip of the electrode is approx. 15 mm in one embodiment. A normal molybdenum strip of a length of, for example, 7.25 mm, such as is also used on the electrical conductor 10 arranged on the side on which the other electrode 4 is situated, may be used as the portion 13*a* of metal strip close to the electrode. The second portion 13*b* of metal strip may then be of a length of, for example, 6 mm and the piece of metal wire 13*c* situated in between may be of a free length of approximately 2 mm.

Figure 6:
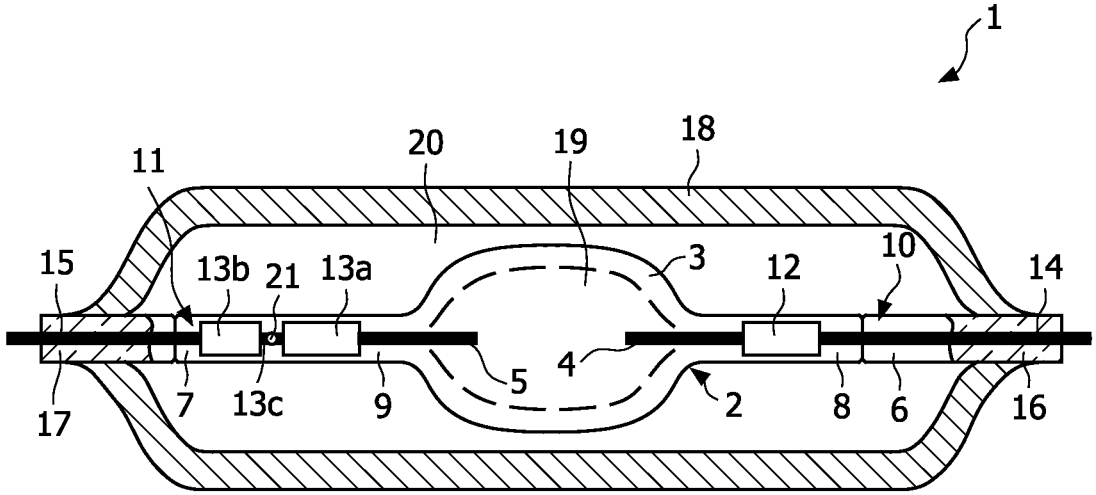
FIG. 6 is a plan view, in section through the outer envelope, of a third embodiment of a gas-discharge lamp according to the invention.

FIG. 6 shows a variant similar to the lamp in FIG. 5, with the hole 21 being situated over the metal wire 13*c* between the portions of metal strip 13*a*, 13*b* in this case and the distance between the hole 21 and the tip of the electrode being approx. 13 mm. Depending on what exactly the production process is, this variant may have advantages from the process engineering point of view with regard to the making of the hole.

Figure 7:
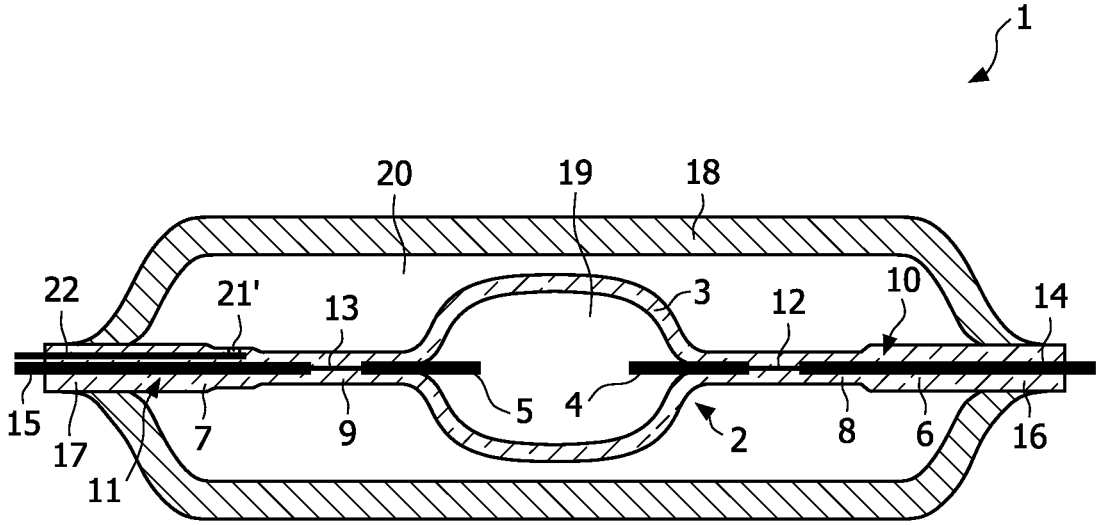
FIG. 7 is a section through a fourth embodiment of a gas-discharge lamp according to the invention.

FIG. 7 shows yet another variant. This lamp differs from the embodiments described above in that, parallel to the supply conductor 11, a further conductor 22, which is insulated from the supply conductor 11 in question for the electrode 5, is run through in the left-hand section of quartz glass 7. The hole 21' in the sealing section 9 then runs only to this additional conductor 22. In this case too, the hole 21 is preferably made within the sealing section 9 in order to ensure that will be no leakage between the interior 20 of the outer envelope 18 and the surroundings. In the embodiment shown in FIG. 7, the additional conductor is a simple molybdenum wire. Basically, however, a conductor having a molybdenum foil, or the like, may also be used in this case, particularly at the end in the region of the hole 21'.

A lamp of this kind having two conductors 11, 22 that have to be run parallel to, but with insulation from, one another in a quartz glass section 7 is very difficult to construct. For this reason the embodiments shown in FIGS. 1 to 3 are preferred from the point of view of manufacture. However, an embodiment of the kind shown in FIG. 7 would be of advantage when, for example, a pulse different than the actual ignition pulse that is applied to the conductor 11 to ignite the discharge in the discharge vessel 3 was to be applied to the additional conductor 22 to ignite the corona discharge, e.g. a pulse earlier in time or a pulse of a different amplitude and/or shape.

Except for the insertion of the second, additional conductor 22 in the section of glass tube 22, the entire production of the lamp can be effected by a normal production process such as has already been described for the embodiments shown in FIGS. 1 to 3. It is only when the electrode 5 and the supply conductor 11 connected thereto is being introduced that the second conductor 22 has to be inserted simultaneously in the appropriate way and it has to be ensured that there is an insulating layer between the two conductors 22, 11. Because this is a relatively complicated process, what suggests itself is for the electrode 5 on this side to be introduced first and the quartz glass vessel 3 firstly to be sealed on this side, so that the lamp can then be filled with the desired substances making up its contents, the second electrode 4 can be introduced and the discharge vessel 3 can finally be sealed on the second side.

Figure 8:
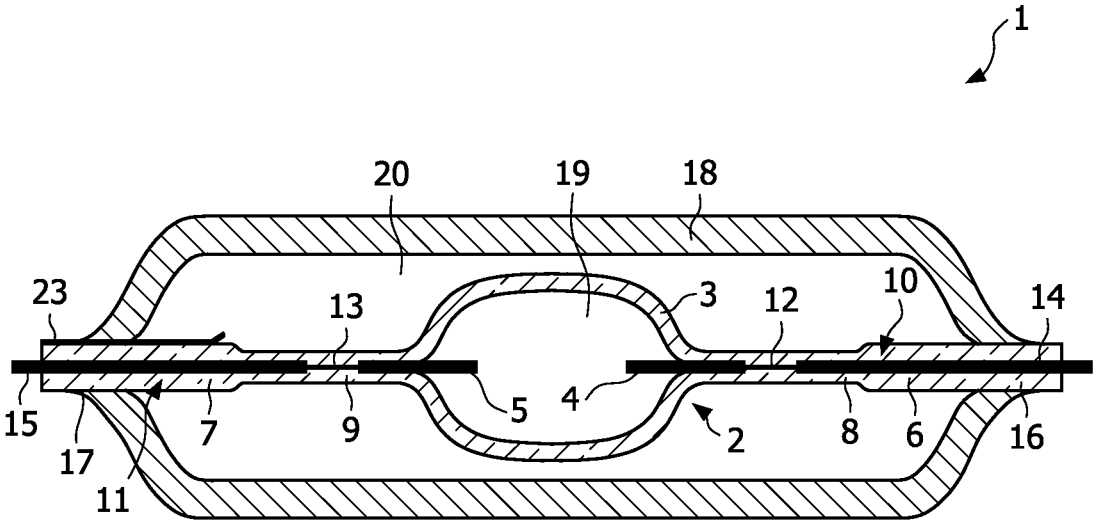
FIG. 8 is a section through a fifth embodiment of a gas-discharge lamp according to the invention.

FIG. 8 shows a fifth variant in which an additional conductor 23 is likewise used. However, in contrast to the embodiment shown in FIG. 6, in this case the conductor 23 is run into the discharge vessel 18 from outside not inside the quartz glass section 7 but adjacent the quartz glass section 7. In the embodiment shown, the additional conductor 23 is run through the roll-on 17 joining the quartz glass envelope 18 to the quartz glass end-piece 7. What this means is that the inner envelope 2 can be produced in the known, conventional way. It is only when the outer envelope 18 is being attached to the inner envelope 2 that care has to be taken to see that the additional conductor 23 is run in with an airtight seal. The conductor 23 may be an additional wire such as is shown in FIG. 5. To form a sharp point, the wire may for example also be bent outwards away from the quartz glass section 7 in this case. Basically however, any other form of conductor may also be used. In particular, it is possible for a thin strip of a conductive coating to be applied to the quartz glass section 7 at this point. However, if this is done it must be ensured that the material in question is one that is resistant to high temperatures for brief periods because the attaching of the outer envelope 18 to the quartz glass sections 6, 7 takes place at around 1,900° C.

Figure 9:
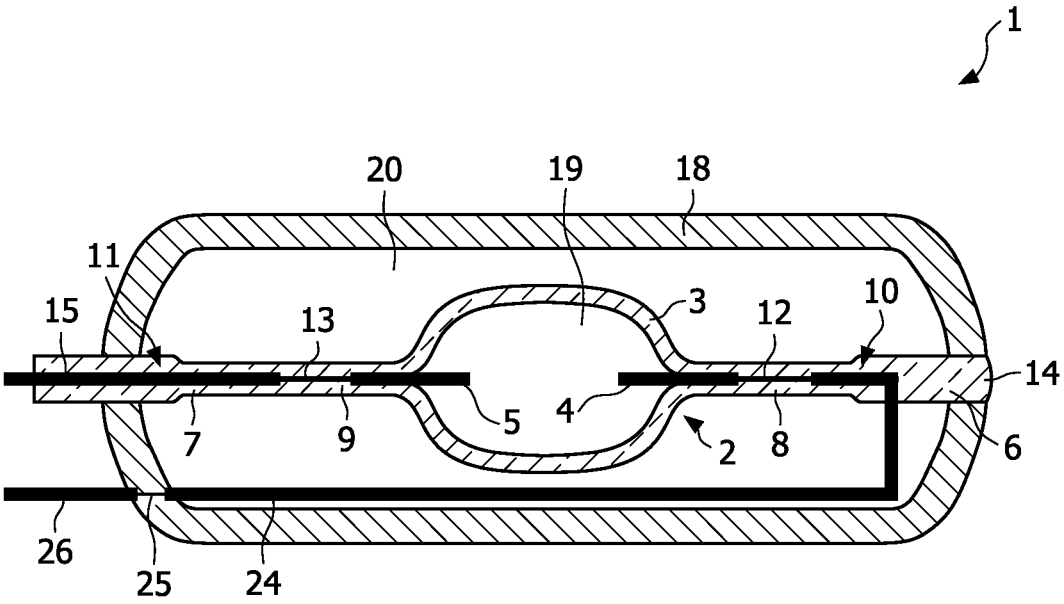
FIG. 9 is a section through a sixth embodiment of a gas-discharge lamp according to the invention.

FIG. 9 shows a sixth variant in which the electrical conductor 10 remote from the cap does not run back to the cap as a return conductor outside the outer envelope 18 in the way that would otherwise be normal but instead is run back, exposed, to the cap end through the outer envelope 18. For this purpose, in the variant shown in FIG. 9, the electrical conductor 10 in question is run out of the quartz glass section 6 behind the sealing section 9 and is then run to the end-face of the outer envelope 18 close to the cap as an exposed, i.e. uninsulated, metal wire 24, of molybdenum for example. In this embodiment, in contrast to what is otherwise normal, the starting pulse to ignite the lamp 1 is applied to the conductor 10 running to the electrode 4 remote from the cap.

In this variant the outer envelope 18 is somewhat wider than in the other embodiments to enable the wire 24 to be run past the discharge vessel 3 at quite a large distance. In this embodiment too, the outer envelope 18 can be fixed to the quartz glass sections 6, 7 of the inner envelope 2. At the end-face close to the cap, the metal wire 24 of the electrical conductor 10 that is run back is run out of the outer envelope with an airtight seal. For this purpose, the wire 24 may be connected to a portion 25 of metal strip, e.g. a molybdenum foil, which is fused into the end-wall. On the outside, this portion 25 of metal strip is connected in turn to a standard supply wire 26 that runs into the cap and to the electronics. No further sealing is required, in this case, of the other electrical conductor 11 that runs to the electrode 5 adjacent the cap, if the outer envelope 18 has a sealed connection to the quartz glass section 7 of the inner envelope 2. Basically however, both the electrical conductors 10, 11 may also be run through the end-wall of the outer envelope 18 at the cap end in parallel with one another and with seals made in the same way.

To conclude, it will again be pointed out that the lamps and methods actually shown and described in the drawings and the description are illustrative embodiments that may be varied by the person skilled in the art over a wide range without exceeding the scope of the invention. For safety's sake, it will also be pointed out that the use of the indefinite article "a" or "an" does not rule out the possibility of the feature concerned being present more than once.

The invention claimed is:

1. A gas-discharge lamp(1) having an inner envelope (2) comprising a discharge vessel (3) and two tubular sections (6, 7) arranged on the discharge vessel (3), two electrodes (4, 5) that project from the tubular sections into the discharge vessel (3) and that, to enable them to be supplied with power, are electrically connected to respective electrical conductors (10, 11) that extend through the associated tubular sections (6, 7) and that are enclosed in the tubular sections (6, 7) with a gastight seal along a sealing section (8, 9), an outer envelope (18) that surrounds the discharge vessel (3), with an airtight seal, while leaving an outer cavity (20) between itself and the discharge vessel (3) and that is filled with a gas at a pressure of not more than 1,000 mbar, wherein, in the outer cavity (20), only a single conductor (11, 22, 23) is in direct contact with the gas filling in the cavity (20), which conductor (11, 22, 23) is run out of the outer envelope (18) to allow a high-voltage pulse for igniting a discharge of the gas filling within the outer cavity between the conductor (11, 22, 23) and its surroundings to be applied.

2. A gas-discharge lamp as claimed in claim 1, characterized in that the conductor (11) in contact with the gas filling in the outer cavity (20) is one of the electrical conductors (10, 11) running to the electrodes (4, 5) or is electrically connected thereto.

3. A gas-discharge lamp as claimed in claim 2, characterized by a hole (21) projecting from the outer cavity (20) into the tubular section (7) and to the electrical conductor (11).

4. A gas-discharge lamp as claimed in claim 3, characterized in that the hole (21) is situated in the tubular section (7) in the region of the sealing section (9) or between two sealing sections that are formed in the relevant tubular section (7).

5. A gas-discharge lamp as claimed in claim 4, characterized in that, in two sections spaced apart from one another, the electrical supply conductor (11) is formed by portions of metal strip (13*a*, 13*b*), that are connected together by a metal wire (13*c*), and the hole (21) is situated in the tubular section (7) at the portion (13*b*) of metal strip situated further away from the discharge vessel (3) or at the metal wire (13*c*) situated between the portions of metal strip (13*a*, 13*b*).

6. A gas-discharge lamp as claimed in claim 3, characterized in that the electrical conductor (11) is formed by a metal strip (13, 13*b*) in the region of the hole (21).

7. A gas-discharge lamp as claimed in claim 1, characterized in that the electrical conductor (10) that is in contact with the gas fitting in the outer cavity (20) and runs to one (4) of the electrodes is run into the outer envelope (18), at a first end-face thereof, at a distance from the second electrical conductor (11) that runs to the other electrode (5) and is run through the outer envelope (18) and, at the end of the inner envelope (2) remote from the first end-face of the outer envelope (18), is run into the tubular section (6) situated there and is connected to the associated electrode (4).

8. A gas-discharge lamp as claimed in Claim 1, characterized in that the conductor (22, 23) is run from outside into the outer cavity (20) through the associated tubular section (7) or along the associated tubular section (7) substantially parallel to an electrical conductor (11) running to the electrodes (4, 5).

9. A gas-discharge lamp as claimed in claim 1, characterized in that the pressure in the outer cavity (20) is between 10 mbar and 300 mbar and preferably between 10 mbar and 100 mbar.

10. A method of operating a gas-discharge lamp (1) as claimed in claim 1, in which a high-voltage pulse is applied to the conductor (11, 22, 23) in contact with the gas tilling in the outer cavity (20) simultaneously with or immediately prior to the application of a starting pulse to the electrodes (4, 5) of the gas-discharge lamp (1).

11. A method as claimed in claim 10, characterized in that the high-voltage pulse for the conductor (11) in contact with the gas tilling in the outer cavity (20) is identical with the starting pulse for the electrode (4, 5) for igniting the gas-discharge lamp (1).

12. method of producing a gas-discharge lamp (1) having the following method steps:

production of an inner envelope (2) having a discharge vessel (3) and two tubular sections (6, 7) arranged on the discharge vessel (3), introduction of two electrodes (4, 5) that project from the tubular sections (6, 7) into the discharge vessel (3), which electrodes (4, 5), to enable them to be supplied with power, are electrically connected to respective electrical conductors (10, 11) that extend through the associated tubular sections (6, 7), and filling of the discharge vessel (3) with the desired filling materials and enclosure of the electrical conductors (10, 11) in the respective tubular sections (6, 7) with a gastight seal along a sealing section (8, 9), attaching of an outer envelope (18) to the tubular sections (6, 7) of the inner envelope (2) so that the outer envelope (18) encloses the discharge vessel (3) with airtight seal while leaving a cavity (20) between itself and the discharge vessel (3), and that the cavity (20) is filled with a gas at a pressure of not more than 1,000 mbar making of a hole (21) in the tubular section (7) associated with one (11) of the two electrical conductors running to the electrodes (4, 5) to expose the electrical conductor to the cavity (20)

running the electrical conductor associated with said hole (21) out of the outer envelope (18) without passing through the cavity (20).

13. Method of producing a gas-discharge lamp (1) having the following method steps:

production of an inner envelope (2) having a discharge vessel (3) and two tubular sections (6, 7) arranged on the discharge vessel (3), introduction of two electrodes (4, 5) that project from the tubular sections (6, 7) into the discharge vessel (3), which electrodes (4, 5), to enable them to be supplied with power, are electrically connected to respective electrical conductors (10, 11) that extend through the associated tubular sections (6, 7), and introduction of an additional conductor (22) into one (7) of the two tubular sections in such a way as to be insulated from the electrical conductor (11) that runs through said one of the two tubular sections, filling of the discharge vessel (3) with the desired filling materials and enclosure of the electrical conductors (10, 11) in the respective tubular sections (6, 7) with a gastight seal along a sealing section (8, 9), the additional conductor (22) being run out of the tubular section (7) laterally, or a hole (21') to the additional conductor (22) being made in the tubular section (7), attaching of an outer envelope (18) to the tubular sections (6, 7) of the inner envelope (2) so that the outer envelope (18) encloses the discharge vessel (3) with an airtight seal while leaving a cavity (20) between itself and the discharge vessel (3), and the cavity (20) is filled with an ignitable gas mixture at a pressure of not more than 1,000 mbar; said ignitable gas mixture comprising one or more gases selected from the group consisting of Xe, Kr, Ar, Ne, He, oxygen, and nitrogen.

14. The method of claim 13 wherein the cavity is filled with a gas pressure of greater than 10 and less than 300 mbar.

15. The method of claim 14 wherein the cavity is tilled with a as pressure of greater than 10 and less than 100 mbar.

16. Method of producing a gas-discharge lamp (1) having the following method steps:

production of an inner envelope (2) having a discharge vessel (3) and two tubular sections (6, 7) arranged on the discharge vessel (3), introduction of two electrodes (4, 5) that project from the tubular sections (6, 7) into the discharge vessel (3), which electrodes (4, 5), to enable them to be supplied with power, are electrically connected to respective electrical conductors (10, 11) that extend through the associated tubular sections (6, 7), and tilling of the discharge vessel (3) with the desired filling materials and enclosure of the electrical conductors (10, 11) in the respective tubular sections (6, 7) with a gastight seal along a sealing section (8, 9), attaching of an outer envelope (18) to the tubular sections (6, 7) of the inner envelope (2) so that the outer envelope (18) encloses the discharge vessel (3) with an airtight seal while leaving a cavity (20) between itself and the discharge vessel (3), and the cavity (20) is filled with a gas mixture comprising one or more ignitable gases at a pressure of not more than 1,000 mbar;

introducing an additional conductor (23) being run into the outer cavity (20) from outside with the outer envelope (18) tightly sealed off so that the said additional conductor (23) is in contact with the gas mixture, and in operation ignites the gas mixture.

17. The method of claim 16 wherein the cavity is tilled with a gas pressure of greater than 10 and less than 300 mbar.

18. The method of claim 17 wherein the cavity is filled with a gas pressure of greater than 10 and less than 100 mbar.

* * * * *